US006244689B1

(12) United States Patent
Matsuda

(10) Patent No.: US 6,244,689 B1
(45) **Date of Patent: *Jun. 12, 2001**

(54) INK JET PRINTER

(75) Inventor: Mitsuhide Matsuda, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/564,858

(22) Filed: May 4, 2000

Related U.S. Application Data

(63) Continuation of application No. 09/054,071, filed on Apr. 6, 1998, now Pat. No. 6,142,608.

(30) Foreign Application Priority Data

Apr. 8, 1997 (JP) ..... 9-089138

(51) Int. Cl.[7] ..... B41J 2/14
(52) U.S. Cl. ..... 347/47

(58) Field of Search ..... 347/20, 44, 47

(56) References Cited

U.S. PATENT DOCUMENTS

| | | | | |
|---|---|---|---|---|
| 5,140,339 | * | 8/1992 | Higuma et al. | 347/43 |
| 5,361,087 | | 11/1994 | Tajima et al. | 347/44 |
| 5,646,657 | | 7/1997 | Aoki | 347/45 |
| 6,142,608 | * | 11/2000 | Matsuda | 347/47 |

* cited by examiner

*Primary Examiner*—John Barlow
*Assistant Examiner*—Craig A. Hallacher
(74) *Attorney, Agent, or Firm*—Stevens, Davis, Miller & Mosher, LLP

(57) ABSTRACT

There is provided an ink-jet printer for jetting ink drops through nozzle holes in which each of the nozzle holes is circular in section, a ratio a/d of a nozzle hole roundness of each of the nozzle holes a to a nozzle hole diameter of each of the nozzle holes d is not more than 0.2, and an amount of ink/jet which is jetted through each of the nozzle holes is not more than 20 pl. According to this ink-jet printer, a good printing quality can be obtained without impact-errors.

4 Claims, 4 Drawing Sheets a = r2′ - r1′ or r2 - r1
d = mean of C1′ and C2′
or
mean of C1 and C2
ratio of a/d = Ratio of Nozzle Hole Roundness a = r2′ - r1′ or r2 - r1 d = mean of C1′ and C2′ or mean of C1 and C2 ratio of a/d = Ratio of Nozzle Hole Roundness

INK JET PRINTER

This application is a continuation of U.S. application Ser. No. 09/054,071, filed Apr. 6, 1998, now U.S. Pat. No. 6,142,608.

BACKGROUND OF THE INVENTION

1. Field of the Invention

The present invention relates to a printer in which an ink-jet recording method is employed in order to jet ink onto, e.g., the surface of a recording paper and more particularly, to an ink-jet printer which enables the improvement of impact-errors and dot-defects during printing.

2. Description of the Prior Art

In recent years, ink-jet printers using an ink-jet device have shown a tendency to have colorizedation facilities and have high quality images. Dots, which are jetted on a recording paper, are required to be highly densified in order to further improve resolution, or heads are required to be arranged in a highly dense formation to miniaturize their dimensions. In addition, the amount of an ink drop to be jetted is also required to be reduced.

FIG. 3 shows a partly diagrammatic sectional view of a prior art ink-jet head. FIG. 4 shows a sectional view taken on line A—A of the ink-jet head in FIG. 3.

As shown in FIGS. 3 and 4, the ink-jet head comprises a flow passage member 8 and a base plate 5. The flow passage member 8 is provided on the upper surface of the base plate 5. An ink supply hole 6 and flow passages 7 are formed in the flow passage member 8. Heaters 4 are provided in the base plate 5. A nozzle plate 3 is fixed on the upper surface of the flow passage member 8 with an adhesive 13. Nozzle holes 2 for jetting ink 1 are formed in the nozzle plate 3. When a voltage is applied to the heaters 4 from a voltage supplying device 9, the heaters 4 heat the ink 1 so that boiling bubbles 10 are formed in the ink 1. As a result, an ink drop 12 is jetted toward a recording paper 11 through one of the nozzle holes 2.

Each of the nozzle holes 2 formed in the nozzle plate 3 has a circular opening. Heretofore, the nozzle holes 2 are formed by a laser processing or an electroforming processing. Such an ink-jet head is used by being incorporated into a conventional ink cartridge, then this ink cartridge is installed in a printer.

An operation and an outline of a printing gist of the ink-jet printer having an arrangement as mentioned above are as follows.

When the heaters 4 abruptly heat the ink 1 by electrifying the heaters 4, boiling bubbles 10 are formed in the ink 1 and then the ink 1 existing in flow passages 7 which leads to portions facing the nozzle holes 2 is pressured to flow toward the nozzle holes 2. Then, a portion of the ink 1 flies out of the nozzle holes 2 into air so as to form the ink drop 12 by means of the surface tension which acts on the ink 1 and then adheres to the recording paper 11.

On the other hand, the boiling bubbles 10 which have been boiled are cooled by the ink 1 existing in the flow passages 7 to abruptly decrease its volume. By a negative pressure occuring on the volume decrease of the boiling bubbles 10 and by the surface tension which acts on the ink 1, the ink 1 is recharged through the ink supply hole 6 and the flow passages 7.

By repeating the above-mentioned operation, in response to a printing signal sent from a computer or the like, the voltage supplying device 9 applies a driving voltage to each of any arbitrary heaters 4 among the heaters 4 in alignment with the position of a carriage of the ink-jet printer, so that the ink drop 12 is successively generated. By such a control and an operation, a portion of the ink 1 is adhered to the recording paper 11 which is fed by a platen roller of the ink-jet printer, thereby enabling the printing by means of dots.

In order to obtain a high quality resolution, the interval between the dots is made to be 42.3 $\mu$m which is nearly half of 84.7 $\mu$m (in the case of 300 dpi). i.e. 600 dots per inch (in the case of 600 dpi). The dot diameter (i.e. the diameter of each of the dots) is miniaturized from 120 $\mu$m to 60 $\mu$m and the amount of the ink drop is reduced to 20 pl or so which is nearly not more than ⅓ of that of a conventional ink-jet printer.

As described above, the nozzle holes 2 of the nozzle plate 3 are formed by a laser processing or an electroforming processing. Since the inside diameter of each of the nozzle holes 2 is so minute, it is difficult to roundly process each of the nozzle holes 2 with a high accuracy. If burrs, processing-strains (strains caused by processing) and the like are formed in the nozzle holes 2, it becomes a great hindrance when printing i.e. jetting the ink drop in an appropriate direction.

FIGS. 5A and 5B shows schematic views illustrating such phenomena. FIG. 5A shows a sectional view illustrating a deviation of the ink drop due to a processing-strain formed in one of the nozzle holes. FIG. 5B shows a plan view illustrating a profile of one of the nozzle holes.

There is a recessed portion 2*a* in a part of the inside circumference of one of the nozzle holes 2. The part of the inside circumeference is outwardly deformed due to a processing-strain caused when forming the nozzle holes 2. Owing to the presence of such a recessed portion 2*a,* an ink portion 23 just before being jetted tends to deform toward the direction of the recessed portion 2*a* as shown in FIG. 5A. Thus, an impact position of the ink portion 23 is deviated from a correct position to be impacted on the recording paper 11.

That is to say, when jetting an ink drop whose amount is extremely more minute than that of a conventional ink drop in order to achieve a higher resolution, the inertia force which acts on the ink drop is smaller than that of the conventional ink drop so that the ink drop is apt to be affected by the surface tension which acts on the ink portion 23. For this reason, if the recessed portion 2*a* as shown in FIG. 5B remains as a result of a processing-strain, the ink portion 23 is forced to be attracted toward the side of the recessed portion 2*a.* Accordingly, impact-errors (i.e. a jetted ink drop 24 impacts a wrong position deviated from a desired correct impact position) thereby causing a problem that the printing quality is considerably deteriorated.

SUMMARY OF THE INVENTION

In view of the foregoing, it is an object of the present invention to provide an ink-jet printer which can realize a good printing quality without impact-errors.

In order to achieve this object, there is provided an ink-jet printer equipped with a printing head for jetting ink drops through nozzle holes in which each of the nozzle holes is circular in section and a ratio $\underline{a}/\underline{d}$ of a nozzle hole roundness of each of the nozzle holes $\underline{a}$ to a nozzle hole diameter of each of the nozzle holes $\underline{d}$ is not more than 0.2, and an amount of ink/jet which is jetted through each of the nozzle holes is not more than 20 pl.

With this arrangement, it is possible to prevent impact-errors which occur on a printing operation, thus it is possible to provide an ink-jet printer which can perform high resolution printing by jetting a more minute ink drop.

DESCRIPTION OF THE PREFERRED EMBODIMENT

Hereinafter, an embodiment of the present invention will be described. A printing operation of an ink-jet printer of the embodiment is quite the same as that of the prior art ink-jet printer, so it will be described with reference to the device arrangement shown in FIGS. 3 and 4.

Figure 1:
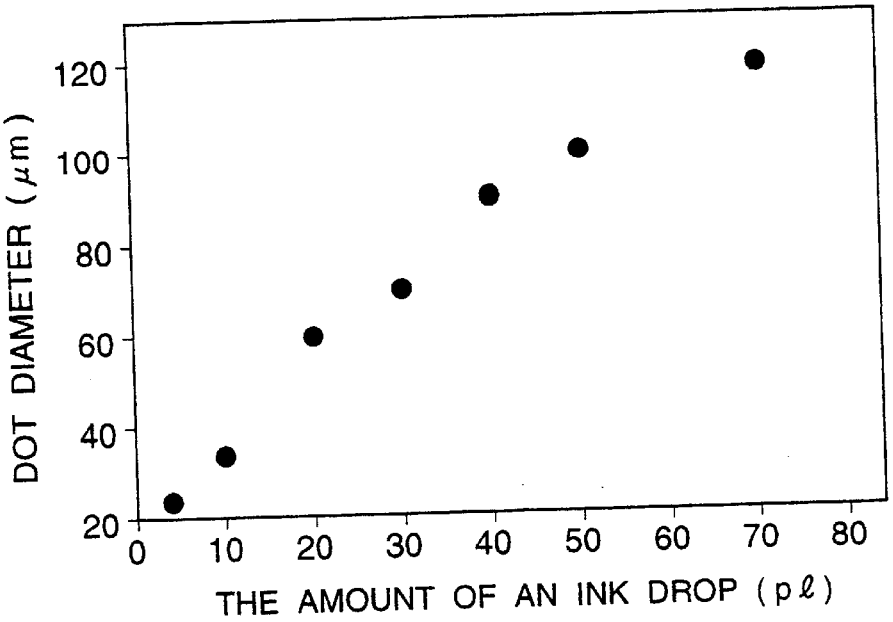
FIG. 1 shows a graph according to an embodiment of the present invention, which illustrates a relationship between an amount of ink drop and a dot diameter of each dot formed on a recording paper.

FIG. 1 shows a graph according to an embodiment of the present invention, which illustrates a relationship between an amount of ink drop and a dot diameter of each dot formed on a recording paper.

These experimental data were obtained under the conditions that the distance between each of the nozzle holes 2 and a recording paper 11 was 1 mm, the physical properties of ink 1 are enumerated as the density: 1 g/cm2, the surface tension: 47 dyn/cm and the viscosity: 1.7 cp, and a coating paper for the ink-jet printer which is manufactured by Nippon Paper Industries Co., Ltd. was used as the recording paper 11.

Figure 2:
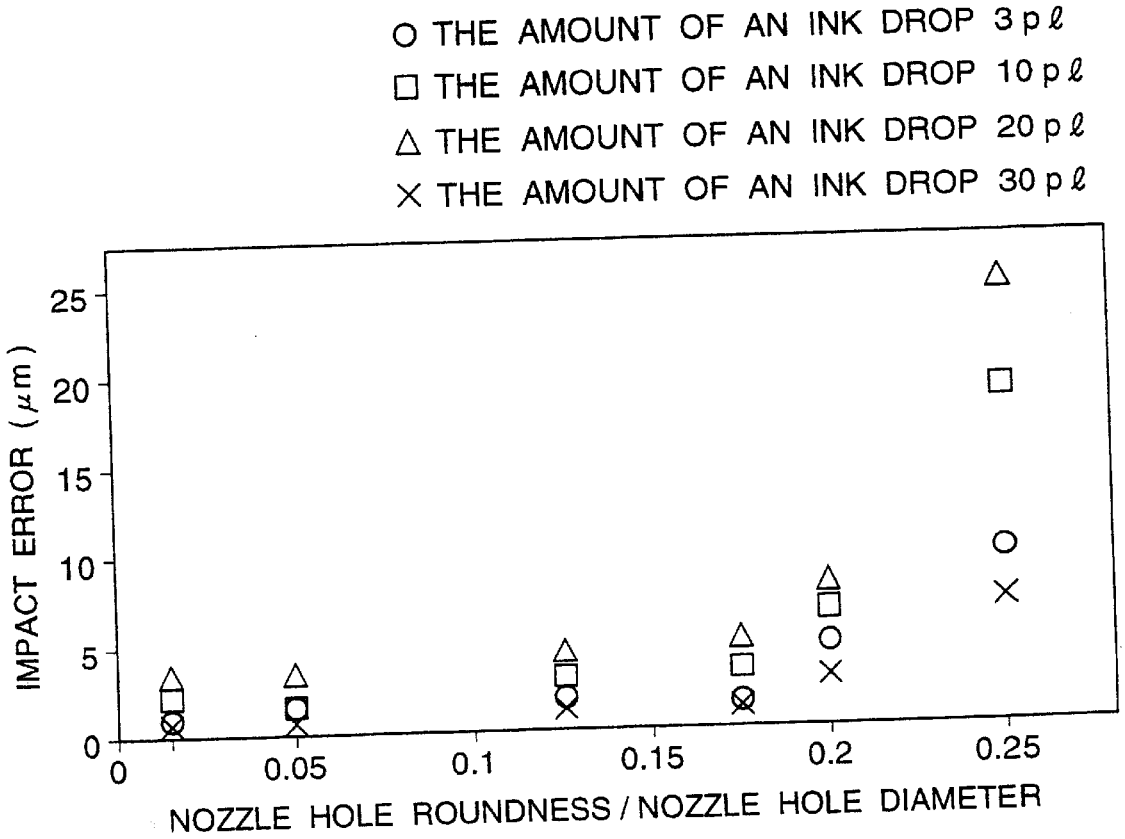
FIG. 2 shows a graph according to an embodiment of the present invention, which illustrates a relationship between a ratio a/d of a nozzle hole roundness of each of the nozzle holes a to a nozzle hole diameter of each of the nozzle holes d and impact-errors in accordance with an amount of each ink drop.

FIG. 2 shows a graph according to an embodiment of the present invention, which illustrates a relationship between a ratio a/d of a nozzle hole roundness of each of the nozzle holes a to a nozzle hole diameter of each of the nozzle holes d and impact-errors in accordance with an amount of each ink drop.

Herein, the printing cycle of a printer head was 5 kHz and the transfer speed of the head was 212 mm/sec.

As for the ink-jet printer arrangement as above, the relationship between the ratio a/d of the nozzle hole roundness of each of the nozzle holes a to the nozzle hole diameter of each of the nozzle holes d and the impact-errors will be described hereinafter.

Herein, when the profile of each of the nozzle holes is placed between two circles each having a concentric relationship with the profile of each of the nozzle holes and the distance between the two circles has the smallest value, the "nozzle hole roundness" of each of the nozzle holes and the "nozzle hole diameter" of each of the nozzle holes are defined by the difference a between the radii of the two circles and the mean value d of the diameters of the two circles, respectively.

Figure 5A:
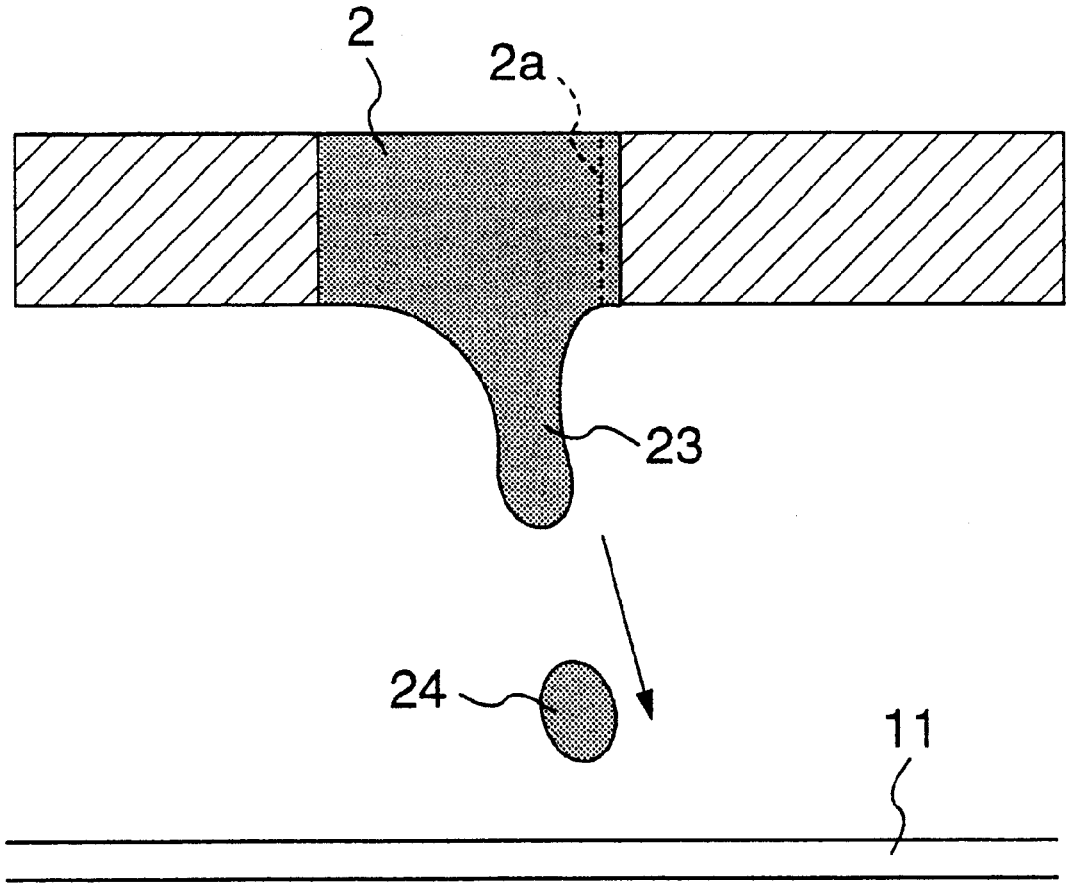
FIG. 5A shows a sectional view illustrating a deviation of the ink drop due to a processing-strain formed in one of the nozzle holes.
Figure 5B:
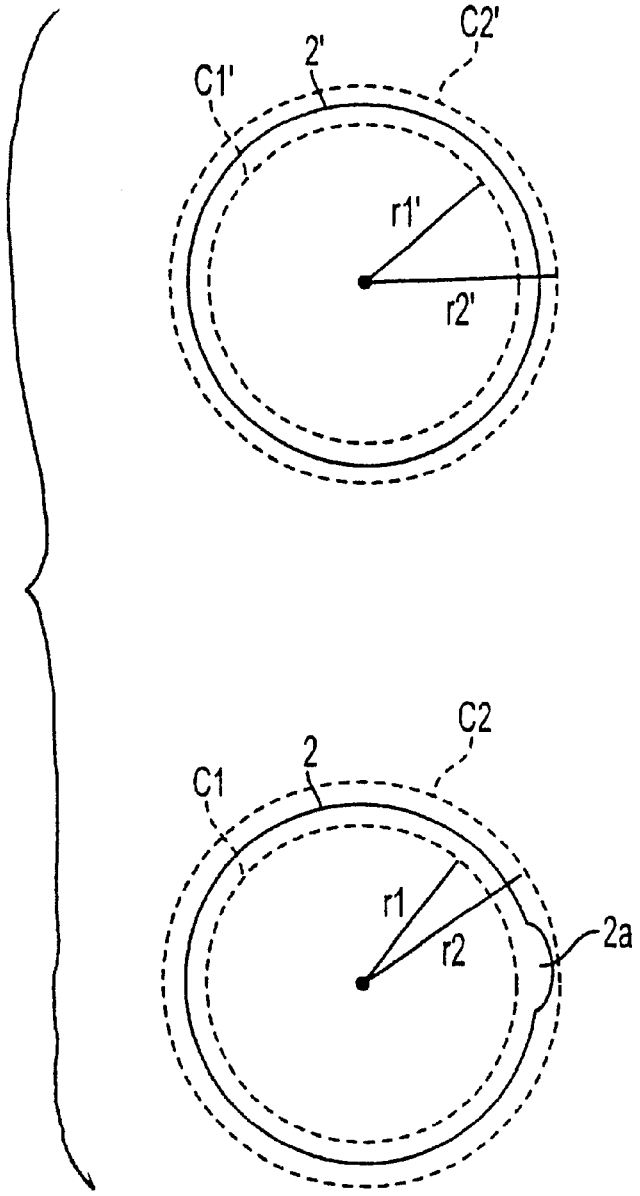
FIG. 5B shows a plan view illustrating a profile of one of the nozzle holes.

In other words, to achieve a more perfectly shaped ink drop on the paper, the circumference of the nozzle 2 should approach that of a perfectly shaped circle, as shown by the ideal nozzle 2' in FIG. 5B. The ideal nozzle 2' does not have any burrs or processing strains. The measure of how close a nozzle approaches a perfectly shaped circle is well-known in the art as the "roundness" of the nozzle.

For example, as shown in FIG. 5B, a perfectly shaped or ideal nozzle 2' is placed between two concentric circles C1' and C2', with circle C2 being slightly larger than the circumference of nozzle 2' and another circle C1' being slightly smaller than the circumference of nozzle 2' (for the sake of illustration, C1' and C2' are spaced further away from nozzle 21 than would be done in practice to obtain a measurement of roundness). The difference in the radii r2' and r1' is equal to the value a. Moreover, the mean diameter of circles C1' and C2' is equal to d. The ratio a/d is a smaller value in a more perfectly shaped nozzle than, for example, imperfect nozzle 2. In nozzle 2, which has recessed portion 2*a* (shown in FIG. 5B), the difference a between radii r2 and r1 of the outer circle C2 and the inner circle C1 is greater than that of the ideal nozzle, resulting in the ratio a/d having a higher value. As shown in FIG. 2, the higher value this ratio has, the larger the impact errors will be.

In view of a permissible value of overlapping on performing color printing, the permissible range of the impact-errors which will be described later was determined to be within 10 $\mu$m of nearly ¼ of 42.3 $\mu$m which is the interval between the dots when printing under a resolution of 600 dpi.

The relationship between the amount of ink drop and the dot diameter of each dot formed on the recording paper is as shown in FIG. 1.

In order to obtain a higher resolution than that of a conventional ink-jet printer, i.e. the resolution of not less than 600 dpi, the dot diameter of each of the dots is required to be not more than 60 $\mu$m as described in the description of the prior art. It is understood from FIG. 1 that the amount of ink drop must be selected to be not more than 20 pl for realizing the above.

Taking account into the data of the impact-errors shown in FIG. 2, when the amount of each ink drop is more than 20 pl, i.e. the resolution is less than 600 dpi, the inertia force which acts on the ink drop is not apt to be affected by the surface tension which acts on the ink, as well as the impact-errors are within a permissible range of 10 $\mu$m or so even if the ratio a/d of the nozzle hole roundness of each of the nozzle holes a to the nozzle hole diameter of each of the nozzle holes d is more than 0.2.

However, when the amount of each ink drop is not more than 20 pl in order to obtain a higher resolution than 600 dpi, if the ratio a/d of the nozzle hole roundness of each of the nozzle holes a to the nozzle hole diameter of each of the nozzle holes d is more than 0.2, since the ink drop comes to be considerably affected by the surface tension which acts on the ink rather than the inertia force which acts on the ink drop, the impact-errors deteriorate extremely.

On the other hand, even if the amount of each ink drop is not more than 20 pl, if only the ratio a/d of the nozzle hole roundness of each of the nozzle holes a to the nozzle hole diameter of each of the nozzle holes d is not more than 0.2, it was confirmed that the impact-errors were within a permissible range of 10 $\mu$m or so and a good printing with no impact-errors could be obtained.

The reason why it is effective that the ratio a/d of the nozzle hole roundness of each of the nozzle holes a to the nozzle hole diameter of each of the nozzle holes d is not more than 0.2 is considered to be as follows. An increase of the length of an edge which would be formed at the portion where the nozzle hole roundness of the circumference of each of the nozzle holes 2 is considerably spoiled (as shown by the recessed portion 2*a* in FIG. 5B) in comparison with that of an ideal nozzle hole 2 and would radially extend outside the circumference of each of the nozzle holes 2, and a local increase of the ink adhesion force and the like caused by the increase of the length of the edge do not occur but the ink adheres uniformly in the nozzle holes 2, so that the ideal ink-flight characteristic in which the ink is not locally attracted when forming an ink drop by the inertia force and the surface tension can be obtained.

In other words, a ratio a/d of not more than 0.2 is effective because the increased length of an ink-wetted edge would occur at the recessed portion 2*a,* where the nozzle hole roundness of the circumference (e.g. outer periphery) of each of the nozzle holes is considerably irregular in comparison with the roundness of an ideal nozzle hole 2'. This irregularity contrasts with the roundness of the ideal ink-flight characteristics of an ideal nozzle hole, in which the ink is not locally attracted when forming an ink drop by the inertia force and the surface tension itself. In an ideal nozzle, the ink uniformly adheres to the nozzle holes without any particular increase in the ink adhesion force at any portion of the nozzle (due to an increased length of an edge) caused by, for example, recessed portion 2*a*.

Figure 3:
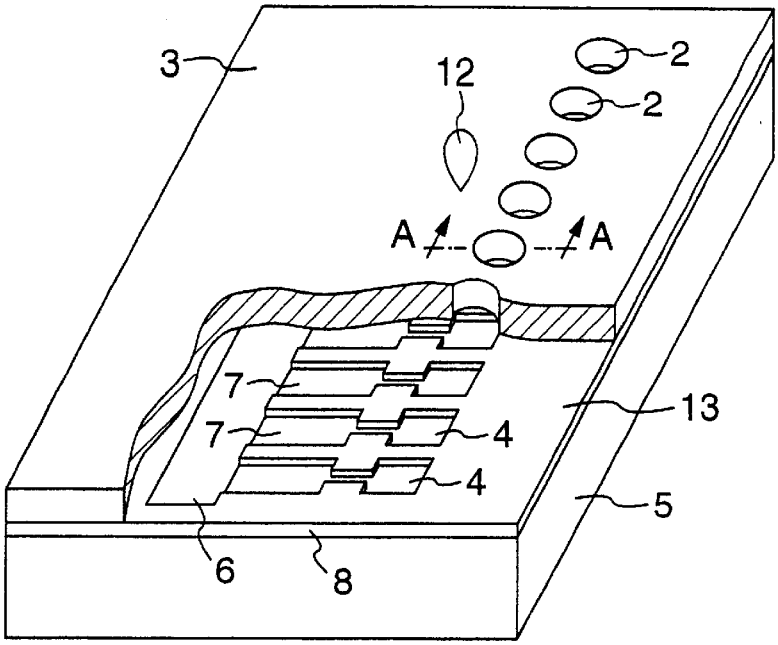
FIG. 3 PRIOR ART
FIG. 3 shows a partly diagrammatic sectional view of a prior art ink-jet head.
Figure 4:
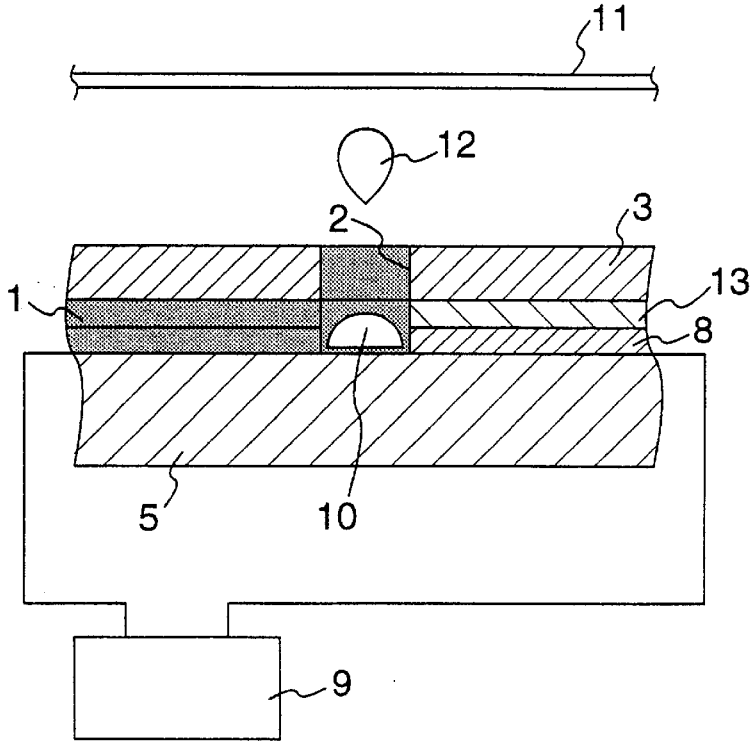
FIG. 4 PRIOR ART
FIG. 4 shows a sectional view taken on line A—A of the ink-jet head in FIG. 3.

Accordingly, in the device arrangement of FIGS. 3 and 4 described in the description of the prior art, even if processing-strains or burrs are formed in the nozzle holes 2 of the nozzle plate 3, if only the nozzle holes 2 are formed so that the ratio a/d of the nozzle hole roundness of each of the nozzle holes a to the nozzle hole diameter of each of the nozzle holes d is maintained not more than 0.2, the occurence of impact-errors on a printing operation can be positively prevented. Therefore, as far as this condition is satisfied, even if the inside diameter of each of the nozzle holes 2 is further decreased, it is possible to provide an ink-jet printer in which a good printing performance without any deterioration due to impact-errors can be obtained.

As described above, in the present invention, since the ratio a/d of the nozzle hole roundness of each of the nozzle holes a to the nozzle hole diameter of each of the nozzle holes d is made to be not more than 0.2, it is possible to more effectively prevent impact-errors and dot-defects during a printing operation even if the amount of each ink drop is not more than 20 pl. Thus, the ink-jet printer according to the present invention can enhance the resolution of a picture in which minuter ink drops are required, thereby enabling a better printing performance.

What is claimed is:

1. An ink-jet printer comprising:

a printing head for jetting ink drops through a plurality of nozzle holes, wherein a ratio a/d of a nozzle hole roundness for each one of the nozzle holes to a nozzle hole diameter of each of the nozzle holes is not more than 0.2, wherein a is a difference between radii of (i) a first concentric circle slightly larger than a circumference of each nozzle and (ii) a second concentric circle slightly smaller than the circumference of each nozzle, and d is a mean diameter of the first and second concentric holes, and wherein a dot diameter is not more than 60 $\mu$m.

2. The ink jet printer according to claim 1, wherein print impact-errors are within a range of 10 $\mu$m.

3. An ink-jet printer comprising:

a printing head for jetting ink drops through a plurality of nozzle holes, wherein a ratio a/d of a nozzle hole roundness for each one of the nozzle holes to a nozzle hole diameter of each of the nozzle holes is not more than 0.2, wherein a is a difference between radii of (i) a first concentric circle slightly larger than a circumference of each nozzle and (ii) a second concentric circle slightly smaller than the circumference of each nozzle, and d is a mean diameter of the first and second concentric holes, and wherein a dot diameter is not more than 60 $\mu$m, and an amount of an ink drop is not more than 20 pl.

4. An ink-jet printer comprising:

a printing head for jetting ink drops through a plurality of nozzle holes, wherein a ratio a/d of a nozzle hole roundness for each one of the nozzle holes to a nozzle hole diameter of each of the nozzle holes is not more than 0.2, wherein a is a difference between radii of (i) a first concentric circle slightly larger than a circumference of each nozzle and (ii) a second concentric circle slightly smaller than the circumference of each nozzle, and d is a mean diameter of the first and second concentric holes, and wherein a dot diameter is not more than 60 $\mu$m, an amount of an ink drop is not more than 20 pl, and print resolution is more than 600 dots per inch.

* * * * *